US011639071B2

(12) United States Patent
Tsuchiya

(10) Patent No.: US 11,639,071 B2
(45) Date of Patent: May 2, 2023

(54) TABLE DEVICE AND PRINTING APPARATUS

(71) Applicant: MIMAKI ENGINEERING CO., LTD., Nagano (JP)

(72) Inventor: Takashi Tsuchiya, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 266 days.

(21) Appl. No.: 16/815,022

(22) Filed: Mar. 11, 2020

(65) Prior Publication Data

US 2020/0298599 A1 Sep. 24, 2020

(30) Foreign Application Priority Data

Mar. 20, 2019 (JP) ..... JP2019-052442

(51) Int. Cl.
*B41J 29/06* (2006.01)
*A47B 9/16* (2006.01)

(52) U.S. Cl.
CPC ..... *B41J 29/06* (2013.01); *A47B 9/16* (2013.01)

(58) Field of Classification Search
None
See application file for complete search history.

(56) References Cited

U.S. PATENT DOCUMENTS 10,092,089 B1 * 10/2018 Yuan ..... A47B 3/002
2002/0044811 A1 * 4/2002 Regev ..... B41J 2/175 400/58
2016/0236493 A1 * 8/2016 Lyman ..... B41J 29/06
2021/0386194 A1 * 12/2021 Egelund ..... B25H 1/18

FOREIGN PATENT DOCUMENTS

| | | |
|---|---|---|
| JP | H07237728 | 9/1995 |
| JP | 2017209721 | 11/2017 |
| WO | 2007043507 | 4/2007 |
| WO | 2017086006 | 5/2017 |

OTHER PUBLICATIONS

Office Action of Japan Counterpart Application, with English translation thereof, dated Sep. 27, 2022, pp. 1-8.

* cited by examiner

*Primary Examiner* — Erica S Lin
(74) *Attorney, Agent, or Firm* — JCIPRNET

(57) ABSTRACT

A table device and a printing apparatus are provided. The table device includes a X-shaped link member in which two long members are turnably coupled in an X-shape, an expansion/contraction mechanism that expands/contracts with at least a pair of X-shaped link members arranged facing each other, a table that is disposed on one end side of the expansion/contraction mechanism and moves in the expansion/contraction direction of the expansion/contraction mechanism, a support member disposed on the other end side of the expansion/contraction mechanism, a coupling member that couples the opposing long members of the long members forming the expansion/contraction mechanism and moves with the expansion/contraction of the expansion/contraction mechanism, and a regulating member that regulates a fluctuation of the coupling member that moves when the expansion/contraction mechanism expands/contracts.

9 Claims, 8 Drawing Sheets

TABLE DEVICE AND PRINTING APPARATUS

CROSS REFERENCE TO RELATED APPLICATIONS

This application claims the priority benefit of Japanese Patent Application No. 2019-052442, filed on Mar. 20, 2019. The entirety of the above-mentioned patent application is hereby incorporated by reference herein and made a part of this specification.

TECHNICAL FIELD

The present disclosure relates to a table device and a printing apparatus.

DESCRIPTION OF THE BACKGROUND ART

For example, some printing apparatuses move the height of a table on which a recording medium is placed in order to set the distance between an ink ejection head and the recording medium (media) to a predetermined value.

In the printing apparatus disclosed in International Publication No. 2017/086006 (i.e., Patent Literature 1), the table moves up and down by an up-down moving mechanism. The up-down moving mechanism of the printing apparatus is configured by a link member in which two long members are connected in an X shape, and the table is moved up and down by the expansion/contraction of the X-shaped link member. Such an up-down moving mechanism is generally configured by at least a pair of left and right link members.

Patent Literature 1: International Publication No. 2017/086006

SUMMARY

In the up-down moving mechanism disclosed in International Publication No. 2017/086006, the pair of link members may not perform the same operation or may move up and down, and the table positioned thereon may be tilted. If the table is tilted, the distance between the recording medium placed on the table and the ink ejection head does not reach a predetermined value, which may cause printing failure.

The present disclosure thus provides a table device and a printing apparatus that can suppress the tilt of a table disposed on an expansion/contraction mechanism.

A table device of the present disclosure includes a link member in which two long members are turnably coupled in an X-shape, an expansion/contraction mechanism that expands/contracts with at least a pair of the link members arranged facing each other, a table that is disposed on one end side of the expansion/contraction mechanism and moves in an expansion/contraction direction of the expansion/contraction mechanism, a support member disposed on the other end side of the expansion/contraction mechanism, a coupling member that couples opposing long members of the long members forming the expansion/contraction mechanism and moves with an expansion/contraction of the expansion/contraction mechanism, and a regulating member that regulates a fluctuation of the coupling member that moves, when the expansion/contraction mechanism expands/contracts.

According to the present configuration, the table is disposed on one end side of the expansion/contraction mechanism, the support member is disposed on the other end side, and the table is moved with the expansion/contraction of the expansion/contraction mechanism. In the expansion/contraction mechanism, a pair of link members arranged facing each other expands/contracts, and the link member is formed by turnably coupling two long members in an X shape.

Here, since the table moves in the expansion/contraction direction of the expansion/contraction mechanism, the table may tilt if there is a difference in expansion/contraction operation of the pair of link members arranged facing each other, or the link member itself moves up and down during the expansion/contraction. Therefore, of the long members forming the expansion/contraction mechanism, the opposing long members are coupled to each other by the coupling member, and fluctuations of the coupling member that moves when the expansion/contraction mechanism expands/contracts are regulated by the regulating member. Thus, since the two long members coupled by the coupling member can only move in the same way in expansion/contraction because they are coupled, and since the fluctuation in the vertical direction is also regulated, the table can be suppressed from tilting in the expansion/contraction of the expansion/contraction mechanism.

In the table device of the present disclosure, the regulating member may be a rod-shaped member inserted into a through hole provided in the coupling member and supported by the support member. According to this configuration, the tilt of the table disposed in the expansion/contraction mechanism can be suppressed with a simple configuration.

In the table device of the present disclosure, a female screw may be provided in the through hole disposed at a predetermined position, a male screw may be provided in the regulating member, that is a rod-shaped member, and screwed into the through hole, and the expansion/contraction mechanism may be expanded/contracted as the coupling member is moved by the rotation of the rod-shaped member.

According to this configuration, the coupling member moves as the regulating member rotates, and the long member moves and the expansion/contraction mechanism expands/contracts with the movement of the coupling member, and thus expansion/contraction of the expansion/contraction mechanism and suppression of tilt of the table can be realized with the same mechanism.

In the table device of the present disclosure, the through hole may be provided in the coupling member so as to be orthogonal to an axis center direction of the coupling member. According to this configuration, the tilt of the table disposed in the expansion/contraction mechanism can be suppressed with a simple configuration.

In the table device of the present disclosure, the coupling member may be provided with a protrusion, and the through hole may be provided in the protrusion so as to be orthogonal to an axis center direction of the coupling member. According to this configuration, the tilt of the table disposed in the expansion/contraction mechanism can be suppressed with a simple configuration.

A printing apparatus of the present disclosure includes the table device, where the table moves in the vertical direction, and a recording medium on which printing is performed is placed on the table. According to this configuration, since the tilt of the table disposed in the expansion/contraction mechanism can be suppressed, the occurrence of printing failure on the recording medium can be suppressed.

A table device and a printing apparatus of the present disclosure have an effect that the tilt of the table disposed in the expansion/contraction mechanism can be suppressed.

DESCRIPTION OF EMBODIMENTS

Hereinafter, a table device according to an embodiment of the present disclosure will be described with reference to the drawings. In the present embodiment, a mode in which the table device of the present disclosure is applied to a printing apparatus will be described as an example.

Figure 1:
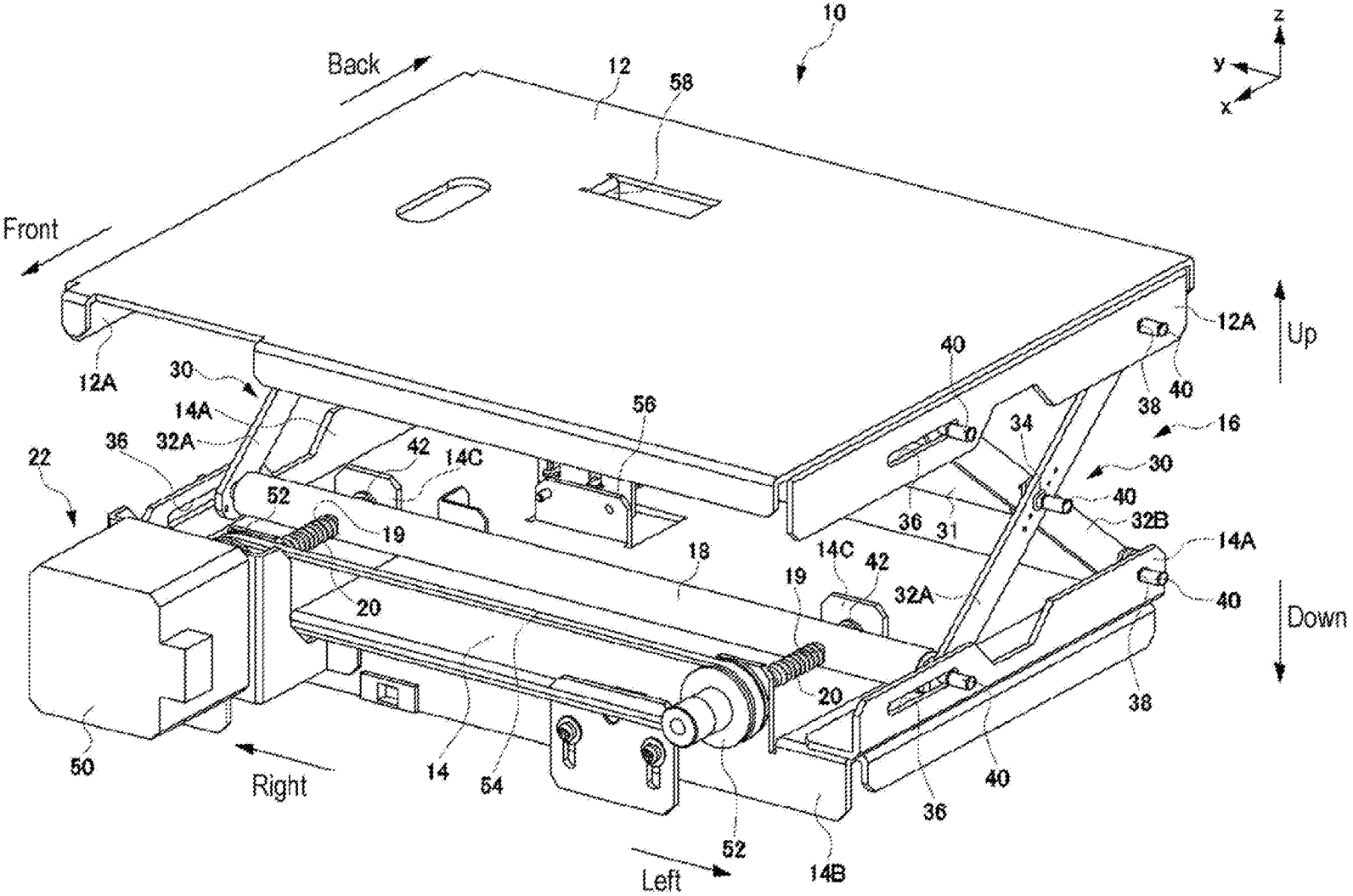
FIG. 1 is a front perspective view of a table device.
Figure 2:
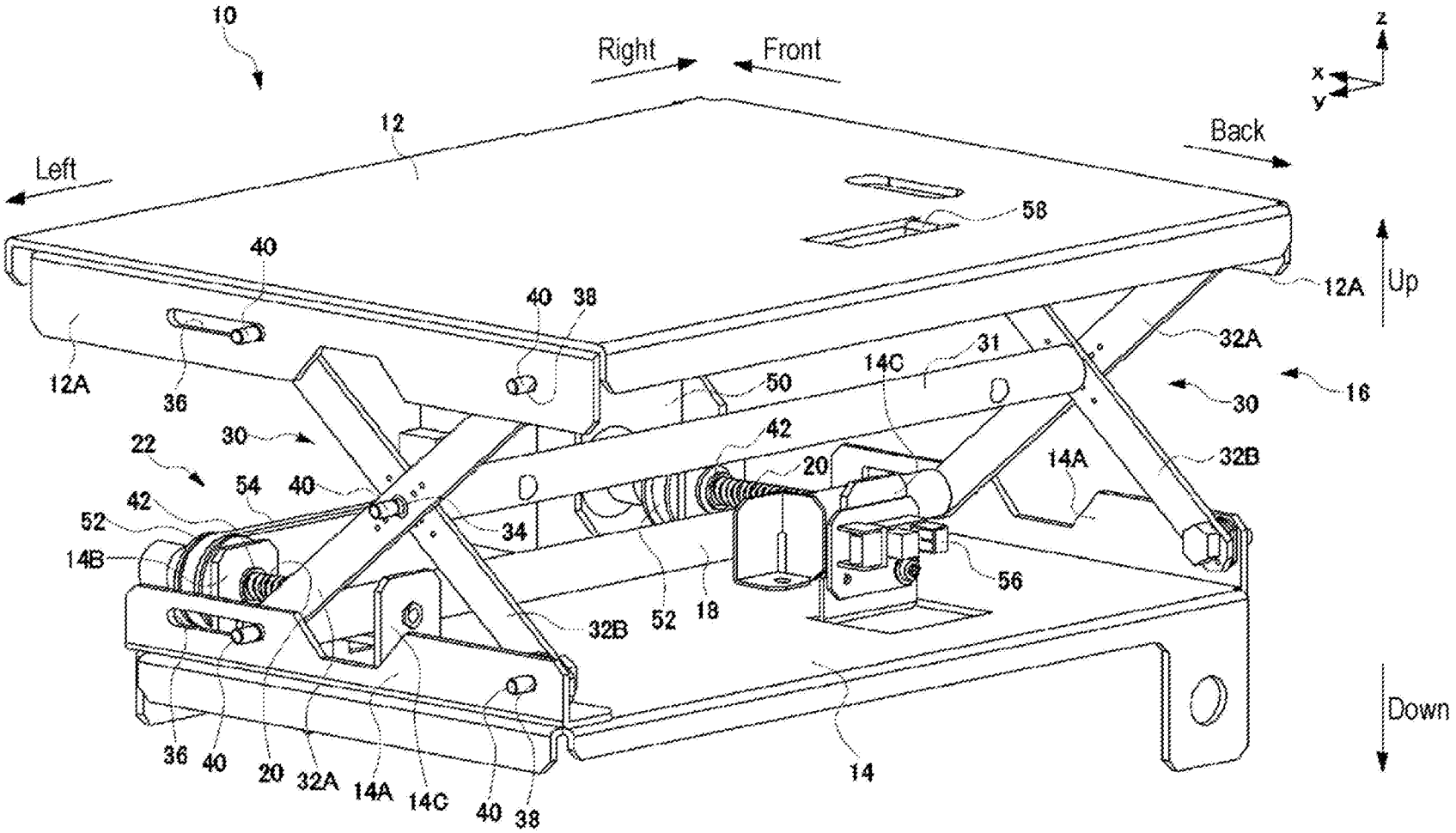
FIG. 2 is a rear perspective view of the table device.
Figure 3:
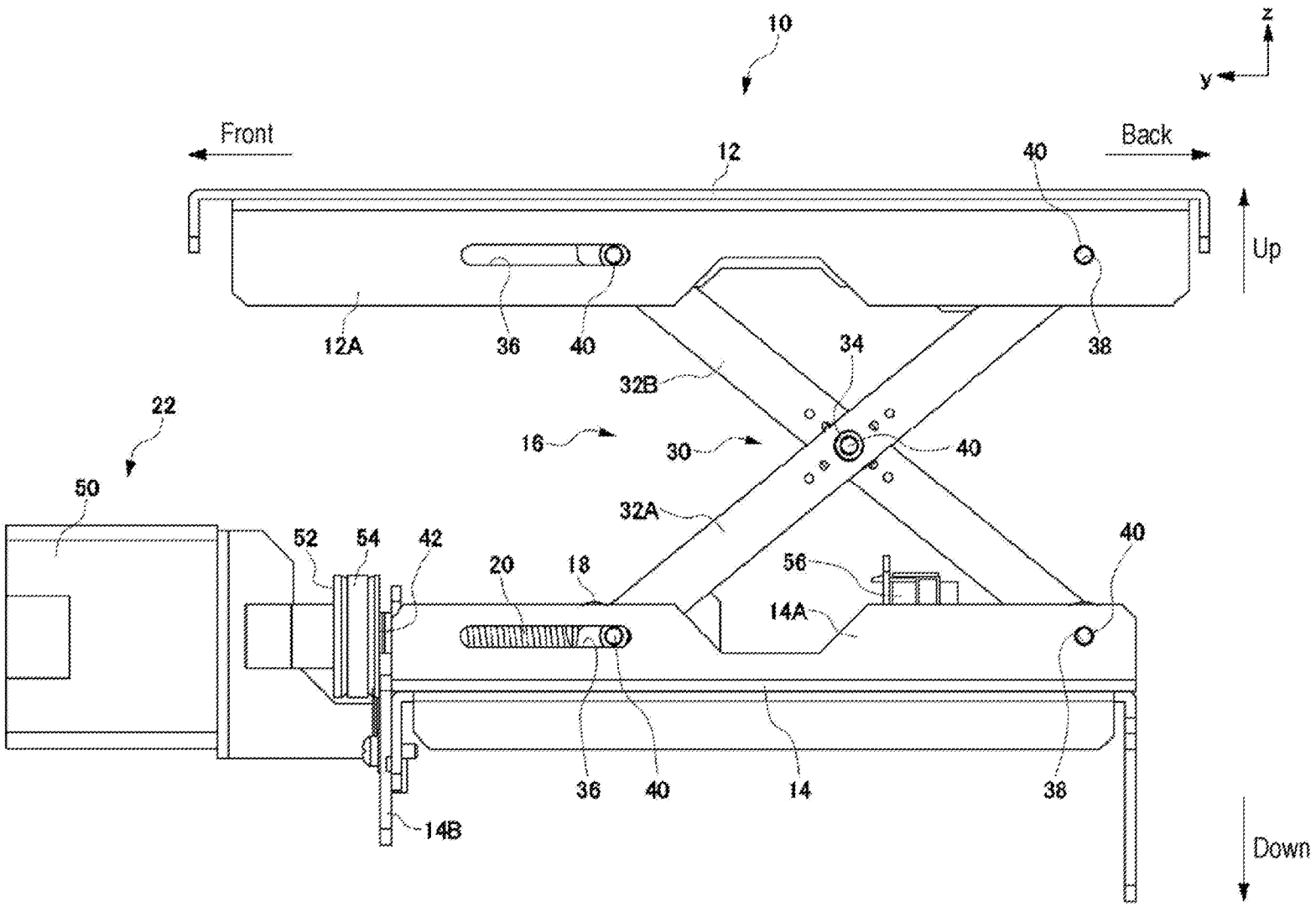
FIG. 3 is a side view of the table device showing a state in which the table is raised.
Figure 4:
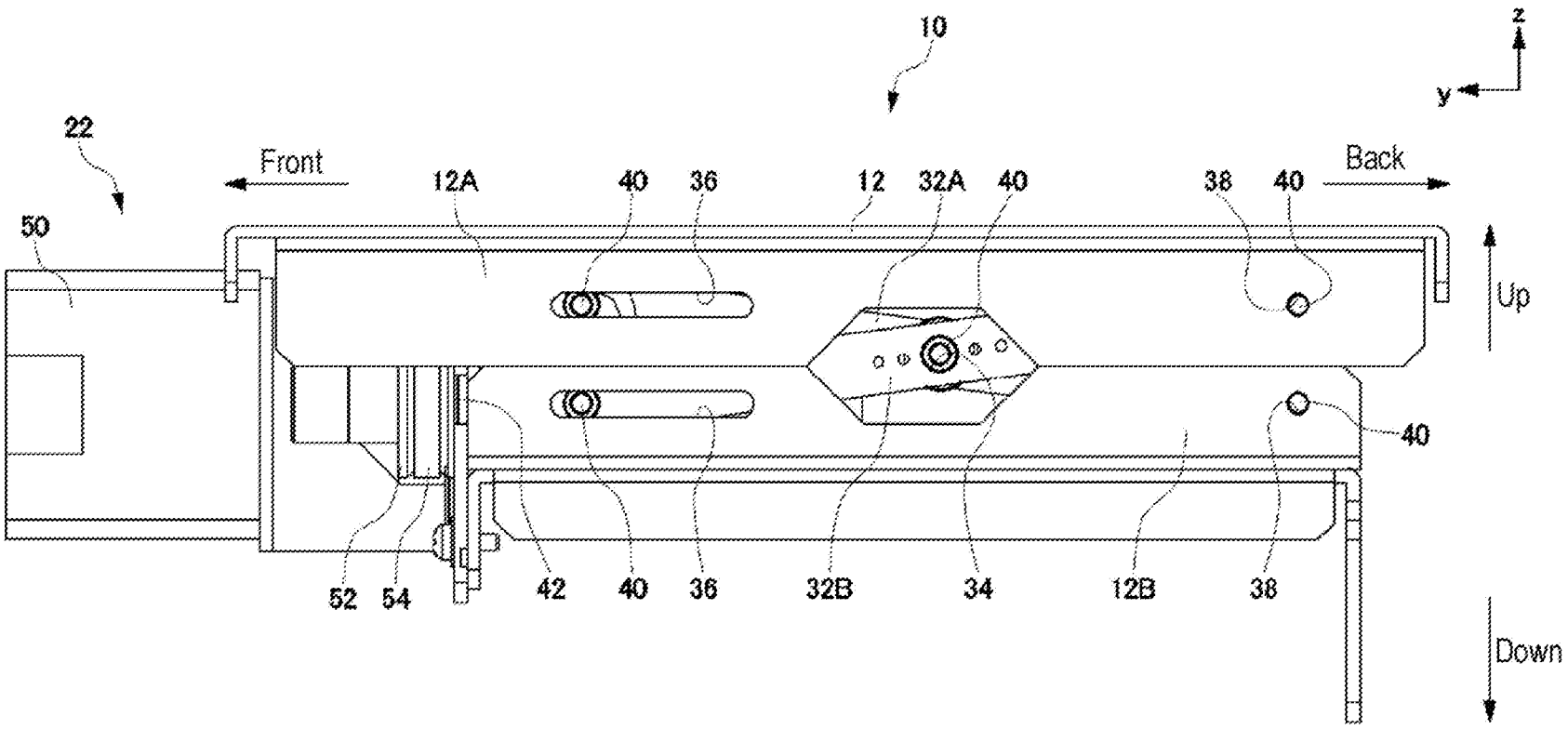
FIG. 4 is a side view of the table device showing a state in which the table is lowered.

FIG. 1 to FIG. 4 are external views of the table device 10 of the present embodiment, where FIG. 1 is a front perspective view of the table device 10, FIG. 2 is a rear perspective view of the table device 10, FIG. 3 is a side view of the table device 10 showing a state in which the table 12 is raised, and FIG. 4 is a side view of the table device 10 showing a state in which the table 12 is lowered. In the present embodiment, the table 12 moves up and down along the z-axis. The horizontal plane of the table 12 is the xy plane, the x-axis direction is also referred to as the front-back direction, and the y-axis direction is also referred to as the left-right direction.

The table device 10 of the present embodiment includes a table 12, a support member 14, an expansion/contraction mechanism 16, a coupling member 18, a regulating member 20, and a drive mechanism 22.

The table 12 is disposed on one end side (upper side in the present embodiment) of the expansion/contraction mechanism 16 and moves in the expansion/contraction direction of the expansion/contraction mechanism 16. An ink ejection head (not shown) is provided above the table 12, and a recording medium to be printed by ink ejected from the ink ejection head is placed on the table 12. The recording medium placed on the table 12 is, for example, a smartphone case or the like, and the height may be different for each recording medium. Thus, the expansion/contraction mechanism 16 moves in the vertical direction according to the height of the recording medium to have the distance between the recording medium placed on the table 12 and the ink ejection head at a predetermined value (e.g., 1 to 2 mm) suitable for printing.

The support member 14 is disposed on the other end side (lower side in the present embodiment) of the expansion/contraction mechanism 16. Note that, the position of the support member 14 is fixed.

The expansion/contraction mechanism 16 has at least a pair of left and right X-shaped link members 30 disposed to face each other, and expands and contracts in the vertical direction. The X-shaped link member 30 is formed by turnably coupling two long members 32A and 32B in an X shape. Specifically, the long members 32A and 32B are turnably coupled in an X shape with the central portion as a coupling point 34. The pair of X-shaped link members 30 are connected to each other at the coupling point 34 by a connecting member 31.

Furthermore, one end of the long member 32A forming the X-shaped link member 30 is connected to the support member 14 so as to be movable in the front-back direction, and the other end of the long member 32A is turnably connected to the table 12. One end of the long member 32B is connected to the table 12 so as to be movable in the front-back direction, and the other end of the long member 32B is turnably connected to the support member 14. Therefore, left and right side plates 12A of the table 12 and left and right side plates 14A of the support member 14 are respectively formed with guide grooves 36 to which one ends of the long members 32A and 32B are connected, and holes 38 to which the other ends of the long members 32A and 32B are connected. A pin 40 is provided at the ends of the long members 32A and 32B connected to the table 12 and the support member 14, and each end of the long members 32A and 32B turns or moves with the pin 40 as the axis.

That is, the expansion/contraction mechanism 16 expands and contracts when the one end of the long members 32A, 32B moves in the front-back direction along the guide groove 36 and the other end of the long members 32A, 32B turns. More specifically, when one end of each of the long members 32A and 32B moves backward, the expansion/contraction mechanism 16 expands and the table 12 moves upward. On the other hand, when one end of the long members 32A and 32B moves forward, which is the opposite direction to backward, the expansion/contraction mechanism 16 contracts and the table 12 moves downward. In the following description, an operation in which the expansion/contraction mechanism 16 expands is also referred to as a leg opening operation, and an operation in which the expansion/contraction mechanism 16 contracts is also referred to as a leg closing operation. Furthermore, in the following description, when the long members 32A and 32B are not distinguished, the A and B at the end are omitted.

The coupling member 18 couples the long members 32 on the right and left facing each other among the long members 32 forming the expansion/contraction mechanism 16, and moves together with the expansion/contraction of the expansion/contraction mechanism 16. The coupling member 18 according to the present embodiment couples the left and right long members 32B as an example. Furthermore, the moving direction of the coupling member 18 is the same as the front-back direction of the table device 10, that is, the direction in which one end of the long member 32 moves along the guide groove 36.

The coupling member 18 of the present embodiment is a rod-shaped member, and its end is connected to one end of the long member 32B. More specifically, the coupling member 18 is connected to the long member 32B so that the central axis thereof is coaxial with the central axis of the pin 40 provided at one end of the long member 32B. Thus, the coupling member 18 moves in the front-back direction while one end of the long member 32B moves along the guide groove 36.

Furthermore, the coupling member 18 is formed with a through hole 19 orthogonal to the axis center direction of the coupling member 18. One through hole 19 of the present embodiment is formed on the left and right side of the coupling member 18 so as to correspond to the connecting position of the regulating members 20, described in detail below, and the through hole is formed with a female screw.

The regulating member 20 regulates fluctuations of the moving coupling member 18 when the expansion/contraction mechanism 16 expands and contracts. In other words, the regulating member 20 regulates fluctuations in directions other than the front-back direction, which is the moving direction of the coupling member 18.

The regulating member 20 of the present embodiment is two rod-shaped members that are inserted into through holes 19 formed on the left and right of the coupling member 18 and supported by the support member 14. The regulating member 20 is formed with a male screw and is screwed into the through hole 19 of the coupling member 18. One end of the rod-shaped regulating member 20 is inserted into and supported by a ball bearing 42 provided on the side plate 14B on the front side of the support member 14. On the other hand, the other end of the regulating member 20 is inserted into and supported by a ball bearing 42 provided on the side plate 14C of the central portion of the support member 14 through the through hole 19. Thus, both ends of the regulating member 20 are supported by the support member 14 through the ball bearing 42 and the side plates 14B and 14C, and can be turned about the axis line.

Furthermore, one end of the regulating member 20 of the present embodiment is connected to the drive mechanism 22 that expands and contracts the expansion/contraction mechanism 16. The drive mechanism 22 of the present embodiment includes a driving motor 50, two pulleys 52, and a timing belt 54. The drive mechanism 22 is supported by the side plate 14B on the front side of the support member 14.

A drive shaft of the driving motor 50 is connected to one end of one regulating member 20 and one pulley 52. The other pulley 52 is connected to one end of the other regulating member 20, and a timing belt 54 is applied on the outer periphery of the two pulleys 52.

With such a configuration of the drive mechanism 22, the coupling member 18 is moved by the rotation of the regulating member 20, and the expansion/contraction mechanism 16 is expanded/contracted. Specifically, the driving force of the driving motor 50 rotates one regulating member 20 and the driving force is transmitted to the other regulating member 20 through the timing belt 54 at the same timing, so that the two regulating members 20 synchronously rotate. Then, as the two regulating members 20 that are male screws rotate by the driving force of the drive mechanism 22, the coupling member 18 formed with the female screw moves. As one end of the long member 32 moves along the guide groove 36 accompanying the movement of the coupling member 18, the expansion/contraction mechanism 16 expands and contracts and the table 12 moves up and down.

In the driving motor 50, the rotation control of the drive shaft is performed by the motor control device (not shown). The drive shaft of the driving motor 50 rotates in a rotation direction determined according to the moving direction of the table 12. That is, the rotation direction of the rotation shaft is opposite between a case where the table 12 moves upward and a case where the table 12 moves downward.

Furthermore, the table device 10 of the present embodiment includes a leg closing detection sensor 56. The leg closing detection sensor 56 detects a state in which the expansion/contraction mechanism 16 is completely contracted, in other words, a state in which the table 12 is fully lowered (state in FIG. 4). The leg closing detection sensor 56 of the present embodiment is provided on the support member 14 as an example, and outputs a detection signal when a pin 58 provided at the lower part of the table 12 is detected. As an example, the pin 58 of the present embodiment is formed by bending a part of the table 12 downward. A detection signal from the leg closing detection sensor 56 is output to the motor control device. When the detection signal is input to the motor control device, the motor control device stops the rotation of the driving motor 50.

Here, since the table 12 moves in the expansion/contraction direction of the expansion/contraction mechanism 16, the table 12 may not be kept horizontal and may tilt if there is a difference in expansion/contraction operation of the pair of X-shaped link members 30 arranged facing each other, or the X-shaped link member 30 itself moves up and down during the expansion/contraction. A case where there is a difference in the expansion/contraction operation of the pair of X-shaped link members 30 is specifically a case where the movement amount and the movement timing in the guide groove 36 of the long members 32A, 32A on the left and right facing each other are different.

If there is a difference in the expansion/contraction operations of the pair of X-shaped link members 30, the coupling member 18 may be subjected to fluctuation that causes tilt in the front-back direction, or if the X-shaped link member 30 itself moves up and down, fluctuation in the vertical direction occurs within a range of a height width of the guide groove 36.

Therefore, the table device 10 of the present embodiment regulates fluctuations of the coupling member 18 that moves when the expansion/contraction mechanism 16 expands/contracts by connecting the regulating member 20 to the coupling member 18. That is, since the regulating member 20 is supported by the support member 14 and its position does not fluctuate, the coupling member 18 can only move along the axial direction of the regulating member 20. Thus, the coupling member 18 is suppressed from tilting in the front-back direction and fluctuating in the vertical direction.

As a result, the long members 32A and 32A coupled by the coupling member 18 move with the same movement amount and timing, and fluctuations in the vertical direction are also regulated, so that the pair of X-shaped link members 30 also expand/contract with the same movement amount and timing and the tilt of the table 12 is suppressed.

Next, the expansion/contraction operation (raising/lowering operation) of the table device 10 provided in the printing apparatus according to the present embodiment will be specifically described.

First, the driving motor 50 starts rotating so that the distance between the recording medium and the ink ejection head becomes a predetermined value according to the thickness of the recording medium placed on the table 12. When the drive shaft of the driving motor 50 rotates, the two regulating members 20 connected to the drive shaft and the pulley 52 rotate. When the regulating member 20 rotates, the coupling member 18 screwed with the regulating member 20 starts to move. Accompanying the movement of the coupling member 18, one end of the left and right long members 32B coupled by the coupling member 18 moves along the guide groove 36. The expansion/contraction mechanism 16 thereby starts to expand/contract. When the distance between the recording medium and the ink ejection head reaches a predetermined value, the driving motor 50 stops rotating, and also stops the expansion/contraction of the expansion/contraction mechanism 16 accordingly. According to such an expansion/contraction operation of the table device 10, the tilt of the table 12 is suppressed and the distance between the recording medium and the ink ejection head is maintained at a predetermined value, so that the occurrence of printing failure on the recording medium is suppressed.

Furthermore, in the table device 10 of the present embodiment, the coupling member 18 moves when the regulating member 20 inserted into the coupling member 18 rotates, and the long members 32 on the left and right facing each other similarly move with the movement of the coupling member 18 so that the expansion/contraction mechanism 16 expands and contracts. Therefore, the table device 10 can realize expansion/contraction of the expansion/contraction mechanism 16 and suppression of the tilt of the table 12 by the same mechanism.

As described above, the present disclosure has been described using the embodiment described above, but the technical scope of the present disclosure is not limited to the scope described in the above embodiment. Various changes or improvements can be added to the embodiment described above without departing from the scope of the disclosure, and a mode in which changes or improvements are added is also encompassed within the technical scope of the present disclosure.

First Modified Example

Figure 5:
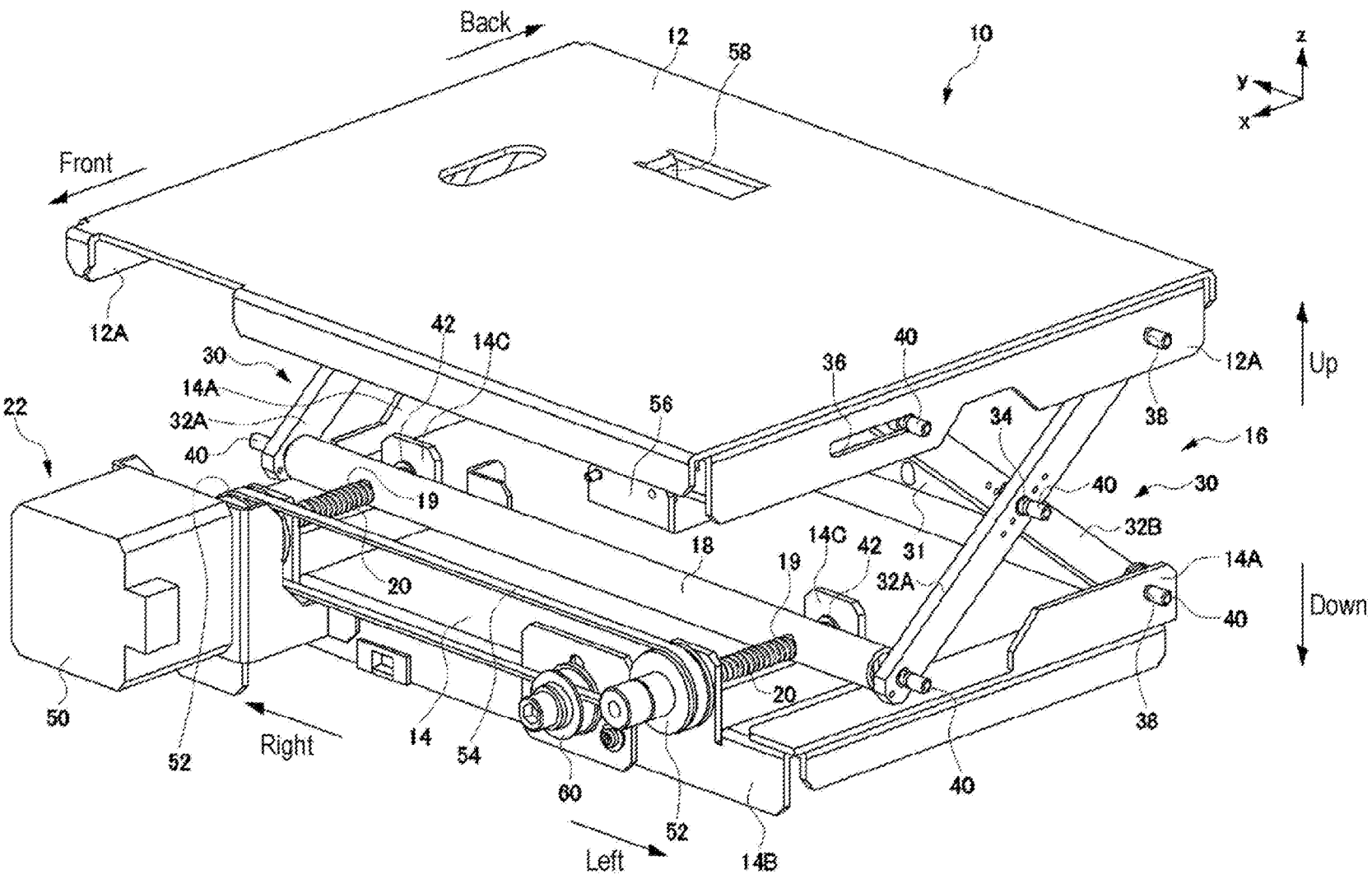
FIG. 5 is a front perspective view of a table device of according to a first modified example.
Figure 6:
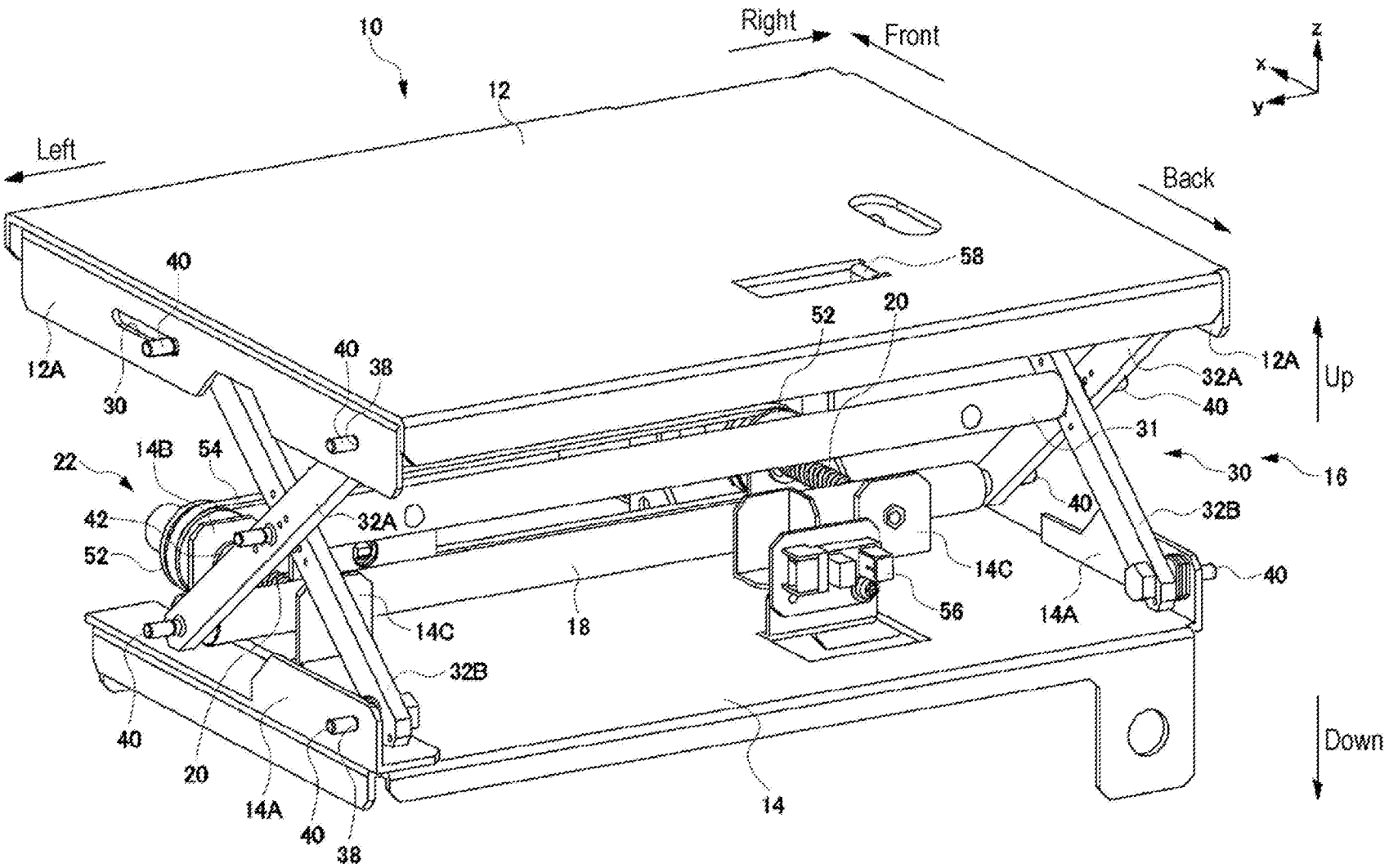
FIG. 6 is a rear perspective view of the table device according to the first modified example.
Figure 7:
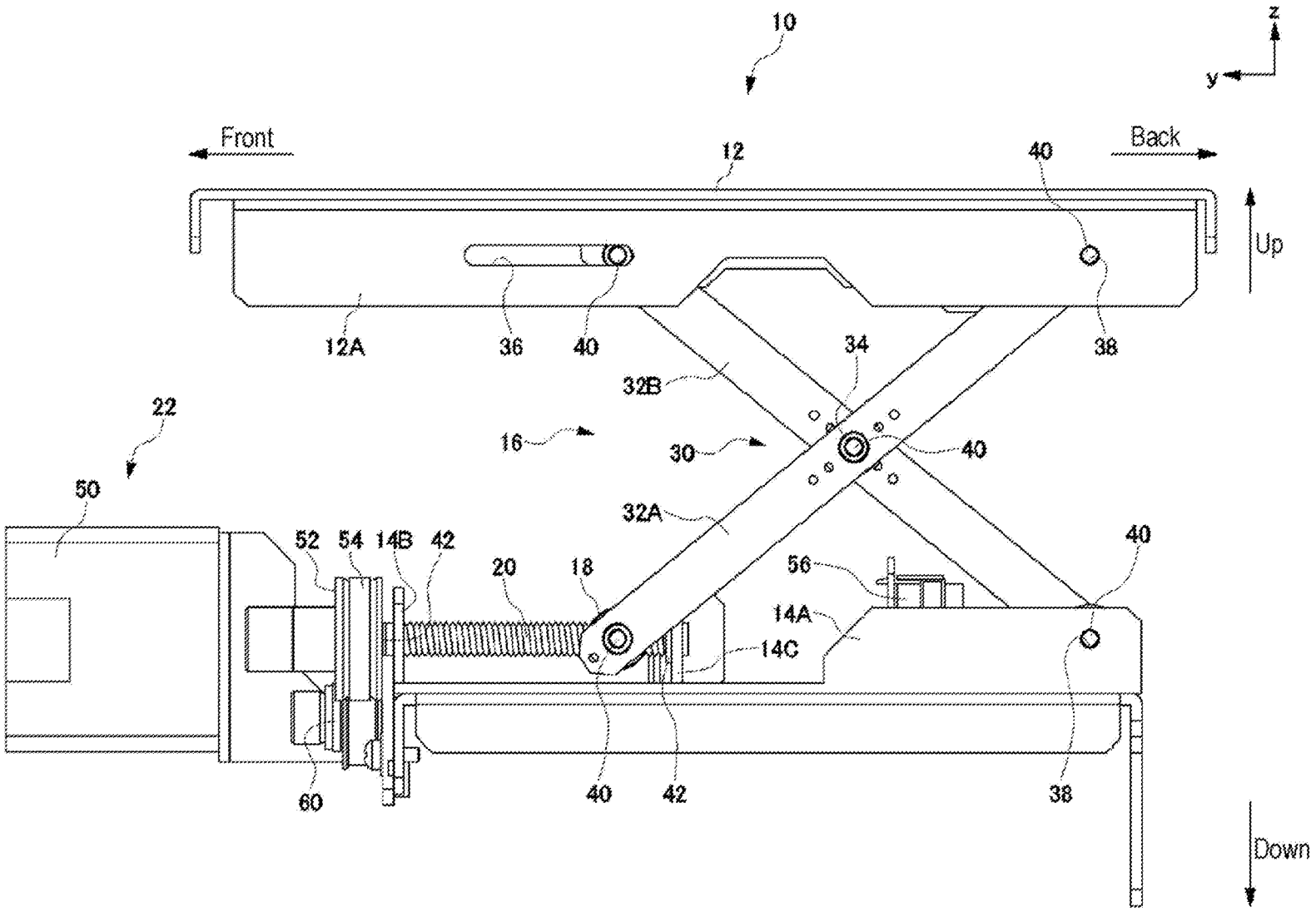
FIG. 7 is a side view of a table device according to the first modified example.

Hereinafter, a first modified example of the present disclosure will be described. FIG. 5 is a front perspective view of the table device 10 of the present modified example, FIG. 6 is a rear perspective view of the table device 10 of the present modified example, and FIG. 7 is a side view of the table device 10 of the present modified example. Note that, among the configurations of the table device 10 according to the present modified example, the same configurations as those of the table device 10 according to the present modified example are denoted by the same reference numerals, and description thereof is omitted.

The guide groove 36 formed in the support member 14 of the above embodiment is not formed on the side plate 14A of the support member 14 of the present modified example. This is because the vertical movement of the expansion/contraction mechanism 16 can be suppressed without the guide groove 36 since the vertical movement is regulated by the regulating member 20.

In the present modified example, the guide groove 36 is not formed in the support member 14, and thus one end of the long member 32 is not supported by the support member 14. Therefore, in the table device 10 of the present modified example, the load on the long member 32 is not dispersed to the support member 14. The strength of the long member 32 thus needs to be stronger than that of the above embodiment, and as an example, the thickness of the long member 32 of the present modified example is twice that of the embodiment described above.

Moreover, the table device 10 of the present modified example includes a tensioner 60 that adjusts the tension of the timing belt 54. The driving force of the driving motor 50 can be appropriately transmitted to the regulating member 20 by adjusting the tension applied to the timing belt 54 by the tensioner 60.

Second Modified Example

Figure 8A:
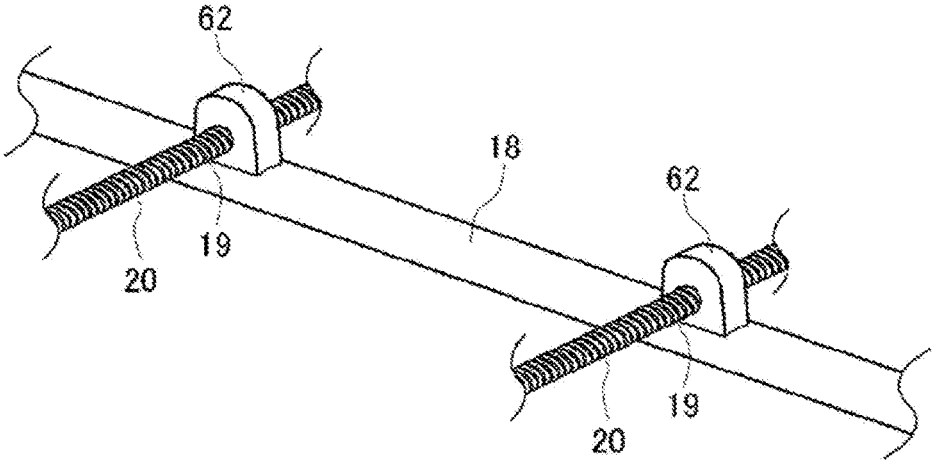
FIGS. 8A to 8C are external views of a coupling member according to a second modified example.
Figure 8B:
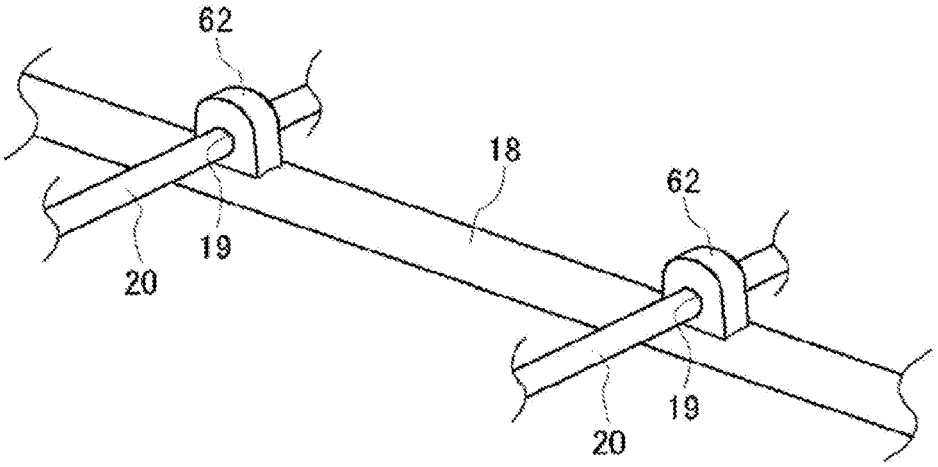
Figure 8C:
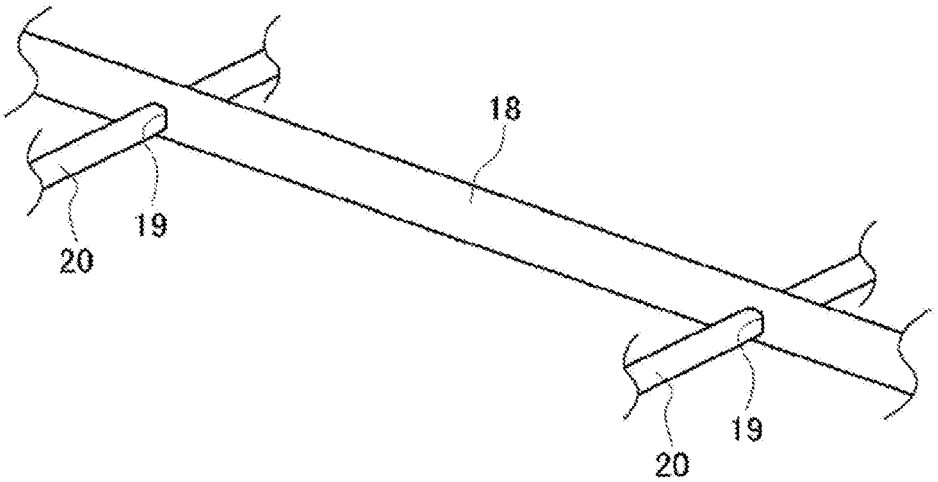

FIGS. 8A to 8C are external views showing a modified example of the coupling member 18.

The coupling member 18 shown in FIGS. 8A and 8B is provided with a protrusion 62, and a through hole 19 is formed in the protrusion 62 so as to be orthogonal to the axis center direction of the coupling member 18. In FIG. 8A, a male screw is formed on the regulating member 20, and a female screw is formed on the through hole 19 of the protrusion 62. Thus, in the configuration of FIG. 8A, the coupling member 18 can be moved and the expansion/contraction mechanism 16 can be expanded/contracted by rotating the regulating member 20 as in the embodiment described above.

On the other hand, no female screw is formed in the through hole 19 of the protrusion 62 shown in FIGS. 8B and 8C. The regulating member 20 is not formed with a male screw, and the regulating member 20 is not connected to the drive mechanism 22. Thus, unlike the embodiment described above, the regulating member 20 does not have a function of expanding/contracting the expansion/contraction member through the coupling member 18. Therefore, the table device 10 having the configuration shown in FIGS. 8B and 8C is provided with a drive mechanism 22 for expanding/contracting the expansion/contraction mechanism 16 at other portions.

Other Modified Examples

In the embodiment described above, the coupling member 18 is connected to one end side of the long members 32A, 32A connected to the guide groove 36 of the support member 14, but this is not the sole case, and the coupling member 18 may be connected to one end side of the long members 32B, 32B connected to the guide groove 36 of the table 12. That is, in the present modified example, the coupling member 18 and the regulating member 20 are provided on the table 12 side, and the coupling member 18 is connected to the long members 32B and 32B on the table 12 side.

Furthermore, in the embodiment described above, the two regulating members 20 are inserted into the coupling member 18, but this is not the sole case, and one or three or more regulating members 20 may be inserted into the coupling member 18.

In the embodiment described above, the expansion/contraction mechanism 16 is configured by a pair of X-shaped link members 30, but this is not the sole case, and the expansion/contraction mechanism 16 may be configured by overlapping two or more pairs of X-shaped link members 30 in the z-axis direction or the expansion/contraction mechanism 16 may be configured by arranging two or more pairs of X-shaped link members 30 in the x-axis direction.

Furthermore, in the embodiment described above, a female screw is formed in the through hole 19 formed in the coupling member 18, but this is not the sole case, and the position of the through hole 19 where the female screw is formed may not be the coupling member 18 as long as the coupling member 18 can be moved along the regulating member 20.

In the embodiment described above, a mode in which the table device 10 is applied to the printing apparatus has been described, but the table device 10 may be applied to other apparatuses. In the embodiment described above, a mode in which the expansion/contraction mechanism 16 expands/contracts in the vertical direction has been described, but this is not the sole case, and for example, a mode in which the table device 10 is inverted 90° and the expansion/contraction mechanism 16 expands/contracts in the lateral direction thus moving the table 12 in the lateral direction may be adopted.

Effects of the Embodiment (1) The table device 10 according to the present embodiment includes the X-shaped link members 30 in which two long members 32 are turnably coupled in an X-shape, the expansion/contraction mechanism 16 that expands/contracts with at least a pair of X-shaped link members 30 arranged facing each other, the table 12 that is disposed on one end side of the expansion/contraction mechanism 16 and moves in the expansion/contraction direction of the expansion/contraction mechanism 16, the support member 14 disposed on the other end side of the expansion/contraction mechanism 16, the coupling member 18 that couples the opposing long members 32 of the long members 32 forming the expansion/contraction mechanism 16 and moves with the expansion/contraction of the expansion/contraction mechanism 16, and the regulating member 20 that regulates the fluctuation of the moving coupling member 18 when the expansion/contraction mechanism 16 expands/contracts.

According to this configuration, the table 12 is disposed on one end side of the expansion/contraction mechanism 16, the support member 14 is disposed on the other end side, and the table 12 is moved with the expansion/contraction of the expansion/contraction mechanism 16. In the expansion/contraction mechanism 16, a pair of X-shaped link members 30 arranged facing each other expands/contracts, and the X-shaped link member 30 is formed by turnably coupling two long members 32 in an X shape.

Here, since the table 12 moves in the expansion/contraction direction of the expansion/contraction mechanism 16, the table 12 may tilt if there is a difference in expansion/contraction operation of the pair of X-shaped link members 30 arranged facing each other, or the X-shaped link member 30 itself moves up and down during the expansion/contraction. Therefore, of the long members 32 forming the expansion/contraction mechanism 16, the opposing long members 32 are coupled to each other by the coupling member 18, and fluctuations of the coupling member 18 that moves when the expansion/contraction mechanism 16 expands/contracts are regulated by the regulating member. Thus, since the two long members 32 coupled by the coupling member 18 can only move in the same way in expansion/contraction because they are coupled, and since the fluctuation in the vertical direction is also regulated, the table 12 can be suppressed from tilting in the expansion/contraction of the expansion/contraction mechanism 16.

(2) In the table device 10 of the present embodiment, the regulating member 20 may be a rod-shaped member inserted into the through hole 19 formed in the coupling member 18 and supported by the support member 14. According to this configuration, the tilt of the table 12 disposed in the expansion/contraction mechanism 16 can be suppressed with a simple configuration.

(3) In the table device 10 of the present embodiment, a female screw may be formed in the through hole 19 provided at a predetermined position, a male screw may be formed in the regulating member 20, which is a rod-shaped member, and screwed into the through hole 19, and the expansion/contraction mechanism 16 may be expanded/contracted as the coupling member 18 is moved by the rotation of the regulating member 20.

According to this configuration, the coupling member 18 moves as the regulating member 20 rotates, and the long member 32 moves and the expansion/contraction mechanism 16 expands/contracts with the movement of the coupling member 18, and thus expansion/contraction of the expansion/contraction mechanism 16 and suppression of tilt of the table 12 can be realized with the same mechanism.

(4) In the table device 10 of the present embodiment, the through hole 19 may be formed in the coupling member 18 so as to be orthogonal to the axis center direction of the coupling member 18. According to this configuration, the tilt of the table 12 disposed in the expansion/contraction mechanism 16 can be suppressed with a simple configuration.

(5) In the table device 10 of the present embodiment, the coupling member 18 may be provided with the protrusion 62, and the through hole 19 may be formed in the protrusion 62 so as to be orthogonal to the axis center direction of the coupling member 18. According to this configuration, the tilt of the table 12 disposed in the expansion/contraction mechanism 16 can be suppressed with a simple configuration.

(6) The printing apparatus according to the present embodiment includes the table device 10, where the table 12 moves in the vertical direction, and a recording medium on which printing is performed is placed on the table 12. According to this configuration, since the tilt of the table 12 disposed in the expansion/contraction mechanism 16 can be suppressed, the occurrence of printing failure on the recording medium can be suppressed.

INDUSTRIAL APPLICABILITY

The present disclosure is useful, for example, as a table on which a recording medium, subjected to printing by a printing apparatus, is placed.

What is claimed is:

1. A table device comprising:

a link member in which two long members are turnably coupled in an X-shape with the same central portion thereof;

an expansion/contraction mechanism that expands/contracts with at least a pair of the link members arranged facing each other;

a table that is disposed on one end side of the expansion/contraction mechanism and moves in an expansion/contraction direction of the expansion/contraction mechanism, wherein a horizontal plane of the table is a xy plane having an x-axis direction referred to as a front-back direction, and an y-axis direction referred to as a left-right direction, and the expansion/contraction direction is a vertical direction orthogonal to the front-back direction and the left-right direction;

a support member, disposed on the other end side of the expansion/contraction mechanism;

a coupling member that couples opposing long members of the long members forming the expansion/contraction mechanism, and the coupling member is configured to move in the front-back direction of the table device together with an expansion/contraction of the expansion/contraction mechanism; and a regulating member configured to regulate a fluctuation in the left-right direction and the vertical direction other than the front-back direction of the coupling member that moves, when the expansion/contraction mechanism expands/contracts, wherein the regulating member comprises:

a first rod-shaped member that is inserted into a first through hole provided on a first end of the coupling member and supported by the support member; and a second rod-shaped member that is inserted into a second through hole provided on a second end of the coupling member with respect to the first end and supported by the support member.

2. The table device according to claim 1, wherein the first through hole and the second through hole are provided with a female screw, the first rod-shaped member and the second rod-shaped member are provided with a male screw, and respectively screwed into the first through hole and the second through hole, and the expansion/contraction mechanism is expanded/contracted as the coupling member is moved by rotation of the first rod-shaped member and the second rod-shaped member.

3. The table device according to claim 2, wherein the first and the second through holes are provided in the coupling member orthogonal to an axis center direction of the coupling member.

4. The table device according to claim 2, wherein the coupling member is provided with a first protrusion and a second protrusion, and the first through hole is provided in the first protrusion and the second through hole is provided in the second protrusion so as to be orthogonal to an axis center direction of the coupling member.

5. A printing apparatus comprising:

the table device according to claim 1, wherein the table moves in the vertical direction, and a recording medium on which printing is performed is placed on the table.

6. A printing apparatus comprising:

the table device according to claim 2, wherein the table moves in the vertical direction, and a recording medium on which printing is performed is placed on the table.

7. A printing apparatus comprising:

the table device according to claim 3, wherein the table moves in the vertical direction, and a recording medium on which printing is performed is placed on the table.

8. A printing apparatus comprising:

the table device according to claim 4, wherein the table moves in the vertical direction, and a recording medium on which printing is performed is placed on the table.

9. The table device according to claim 1, further comprising:

a driving motor, configured to transmit a driving force to first rod-shaped member and the second rod-shaped member to make first rod-shaped member and the second rod-shaped member synchronously rotate.

* * * * *